US008121528B2

(12) United States Patent
Pawlik et al.

(10) Patent No.: US 8,121,528 B2
(45) Date of Patent: Feb. 21, 2012

(54) APPARATUSES USEFUL FOR PRINTING AND METHODS OF TREATING MARKING MATERIAL ON MEDIA

(75) Inventors: Robert S. Pawlik, Canandaigua, NY (US); Nathan Smith, Hamlin, NY (US); Brian Gillis, Penfield, NY (US); Thomas C. Fowler, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 372 days.

(21) Appl. No.: 12/490,755

(22) Filed: Jun. 24, 2009

(65) Prior Publication Data

US 2010/0329753 A1 Dec. 30, 2010

(51) Int. Cl.
*G03G 15/20* (2006.01)

(52) U.S. Cl. ..... 399/329

(58) Field of Classification Search ..... 399/329, 399/328, 331; 219/216, 469–471
See application file for complete search history.

(56) References Cited

U.S. PATENT DOCUMENTS 5,148,226 A * 9/1992 Setoriyama et al. ..... 399/329
7,228,082 B1 6/2007 Davidson et al.

OTHER PUBLICATIONS

Nathan E. Smith; U.S. Appl. No. 12/244,320, filed Oct. 2, 2008.
Anthony S. Condello et al.; U.S. Appl. No. 12/490,601, filed Jun. 24, 2009.

* cited by examiner

*Primary Examiner* — Susan Lee
(74) *Attorney, Agent, or Firm* — Ronald E. Prass, Jr.; Prass LLP

(57) ABSTRACT

Apparatuses useful for printing and methods of treating marking material on media are provided. An exemplary embodiment of the apparatuses useful for printing includes a roll including a first outer surface; a continuous belt including an inner surface and a second outer surface forming a nip by contact with the first outer surface, the belt being driven to rotate by rotation of the roll; a heater disposed inside of the belt and comprising a first heating surface contacting the inner surface of the belt at the nip; and a heating fin in thermal contact with the heater, the heating fin including a second heating surface extending circumferentially in contact with a pre-nip portion of the inner surface of the belt. Thermal energy is conducted from the heater to the heating fin. The second heating surface pre-heats the pre-nip portion of the belt before the pre-nip portion is rotated to the nip, and the first heating surface of the heater heats the pre-heated, pre-nip portion at the nip.

20 Claims, 4 Drawing Sheets

APPARATUSES USEFUL FOR PRINTING AND METHODS OF TREATING MARKING MATERIAL ON MEDIA

BACKGROUND

In some printing processes, images are formed on media using a marking material that is treated to fix the marking material onto the media. Printing apparatuses that are used for such printing processes can include members having opposed surface forming a nip. During printing processes, media are fed to the nip, where the marking material is treated to fix the images onto the media.

It would be desirable to provide apparatuses and methods for treating marking material on media that can provide reduced warm-up times and higher energy efficiency.

SUMMARY

Embodiments of apparatuses useful for printing and methods of treating marking material on media are disclosed. An exemplary embodiment of the apparatuses useful for printing comprises a roll including a first outer surface; a continuous belt including an inner surface and a second outer surface forming a nip by contact with the first outer surface, the belt being driven to rotate by rotation of the roll; a heater disposed inside of the belt and comprising a first heating surface contacting the inner surface of the belt at the nip; and a heating fin in thermal contact with the heater, the heating fin including a second heating surface extending circumferentially in contact with a pre-nip portion of the inner surface of the belt. Thermal energy is conducted from the heater to the heating fin. The second heating surface pre-heats the pre-nip portion of the belt before the pre-nip portion is rotated to the nip, and the first heating surface of the heater heats the pre-heated, pre-nip portion at the nip.

DRAWINGS

DETAILED DESCRIPTION

Figure 1:
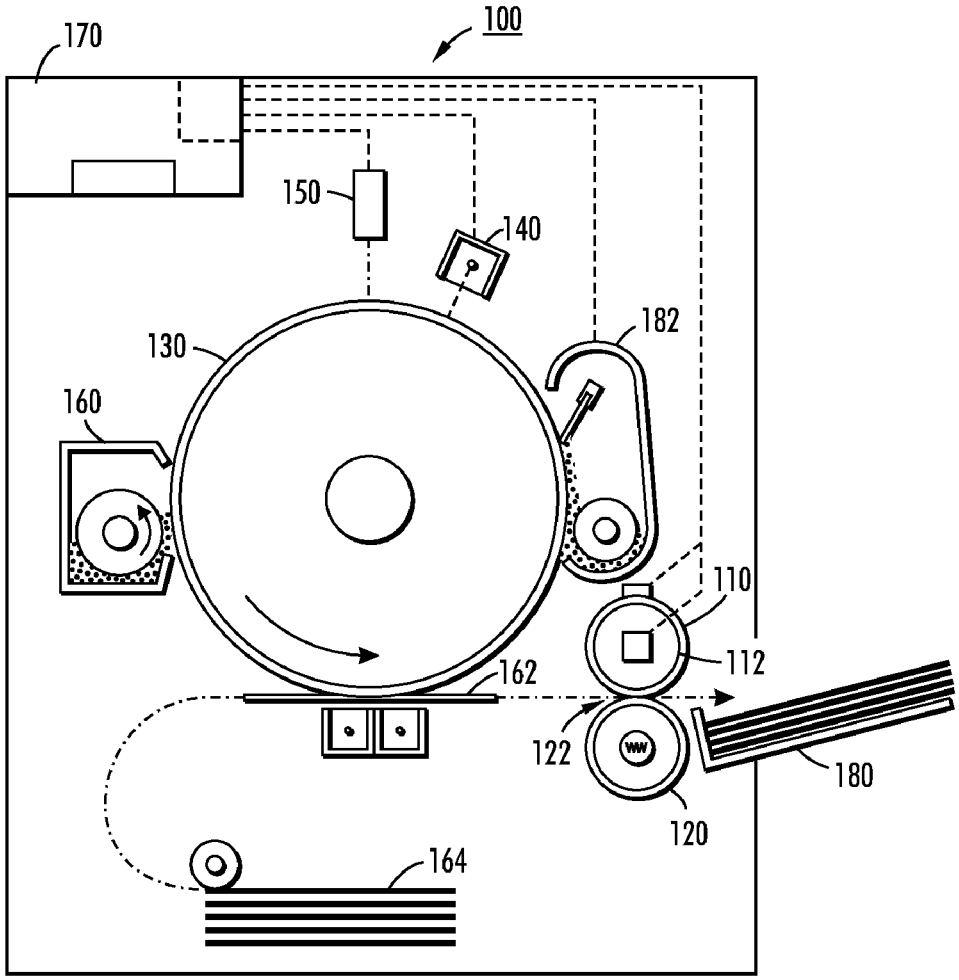
FIG. 1 illustrates an exemplary embodiment of a printing apparatus including a fixing device.

The disclosed embodiments include an apparatus useful for printing, which comprises a roll including a first outer surface; a continuous belt including an inner surface and a second outer surface forming a nip by contact with the first outer surface, the belt being driven to rotate by rotation of the roll; a heater disposed inside of the belt and comprising a first heating surface contacting the inner surface of the belt at the nip; and a heating fin in thermal contact with the heater, the heating fin including a second heating surface extending circumferentially in contact with a pre-nip portion of the inner surface of the belt. Thermal energy is conducted from the heater to the heating fin. The second heating surface pre-heats the pre-nip portion of the belt before the pre-nip portion is rotated to the nip, and the first heating surface of the heater heats the pre-heated, pre-nip portion at the nip.

The disclosed embodiments further include a fuser, which includes a pressure roll including a first outer surface; a continuous fuser belt including an inner surface and a second outer surface forming a nip by contact with the first outer surface, the fuser belt being driven to rotate by rotation of the pressure roll; a heater disposed inside of the belt and comprising a planar first heating surface contacting the inner surface of the fuser belt at the nip; and a heating fin in thermal contact with the heater, the heating fin including a curved second heating surface extending circumferentially in contact with a pre-nip portion of the inner surface of the fuser belt. Thermal energy is conducted from the heater to the heating fin. The second heating surface pre-heats the pre-nip portion of the fuser belt before the pre-nip portion is rotated to the nip, and the first heating surface of the heater heats the pre-heated, pre-nip portion at the nip.

The disclosed embodiments further include a method of treating a marking material on a medium, which comprises feeding a medium with a marking material to a nip formed by a first outer surface of a roll contacting a second outer surface of a belt; rotating the belt relative to a heater disposed inside of the belt and comprising a first heating surface contacting the inner surface of the belt at the nip and relative to a heating fin in thermal contact with the heater, the heating fin including a second heating surface extending circumferentially in contact with a pre-nip portion of the inner surface of the belt; activating the heater to conduct thermal energy from the heater to the heating fin to pre-heat the pre-nip portion of the belt with the second heating surface before the pre-nip portion is rotated to the nip and to heat the pre-heated, pre-nip portion with the first heating surface at the nip; and contacting the medium with the first outer surface of the belt and second outer surface of the belt at the nip to treat the marking material.

As used herein, the term "printing apparatus" can encompass any apparatus, such as a copier, bookmaking machine, multifunction machine, and the like, or portions of the apparatuses, that can perform a print outputting function for any purpose.

FIG. 1 illustrates an exemplary printing apparatus 100 disclosed in U.S. Pat. No. 7,228,082, which is incorporated herein by reference in its entirety. The printing apparatus 100 includes a fuser 110 with a rotatable, continuous belt 112 and a pressure roll 120 defining a nip 122. The printing apparatus 100 further includes a rotatable photoreceptor 130. To form a toner image on the photoreceptor 130, a charging device 140 is activated to charge the outer surface of the photoreceptor 130. The photoreceptor 130 is rotated to an exposure device 150 to form an electrostatic latent image on the photoreceptor 130. Then, the photoreceptor 130 is rotated to a developer device 160, which applies toner particles to the electrostatic latent image to form the toner image on the photoreceptor 130. The toner image is transferred from the photoreceptor 130 to a medium 162, e.g., a sheet of paper, conveyed from a sheet supply stack 164. The medium 162 on which the toner image has been formed is conveyed to the nip 122 of fuser 110. The printing apparatus 100 includes a controller 170 configured to control operation of the image-forming devices during printing. After the medium 162 passes through the nip 122, the medium is conveyed to an output tray 180. A cleaning device 182 removes residual toner particles from the photoreceptor 182 before the imaging process is repeated for another medium.

In fusers, increased demands for energy efficiency can impose limits on warm-up times. In such fusers, there is a need to be able to heat the fusing surface of a fusing member, e.g., a fuser belt, from a stand-by temperature to the desired temperature more quickly. It has been determined that a low-mass fuser belt can be heated quickly with a heater to reduce warm-up time. However, it is desirable that the amount of surface dwell between the heater and the fusing belt be sufficiently-high to supply sufficient thermal energy to the fuser belt to heat media to a desired temperature with the fuser belt. The amount of surface dwell that is sufficient can be higher in fuser belts comprised of polymeric materials that have relatively low thermal conductivity. It is desirable to reduce temperature "droop," which is caused by the temperature of the fuser belt falling to below a desired temperature (e.g., a temperature set point) as a result of media absorbing more thermal energy from the fuser belt than is supplied to the fuser belt by the heater. When the temperature droop of the fuser belt is too large, poor fixing of marking material on media can occur.

Fixing devices for fixing marking materials on media are provided. The fixing devices include opposed members that can apply heat and pressure to media to fix marking material onto the media. Embodiments of the fusers can provide increased fuser dwell and low warm-up times. Embodiments of the fusers can control temperature droop of the fusing member by achieving a balanced thermal input/thermal output.

Figure 2:
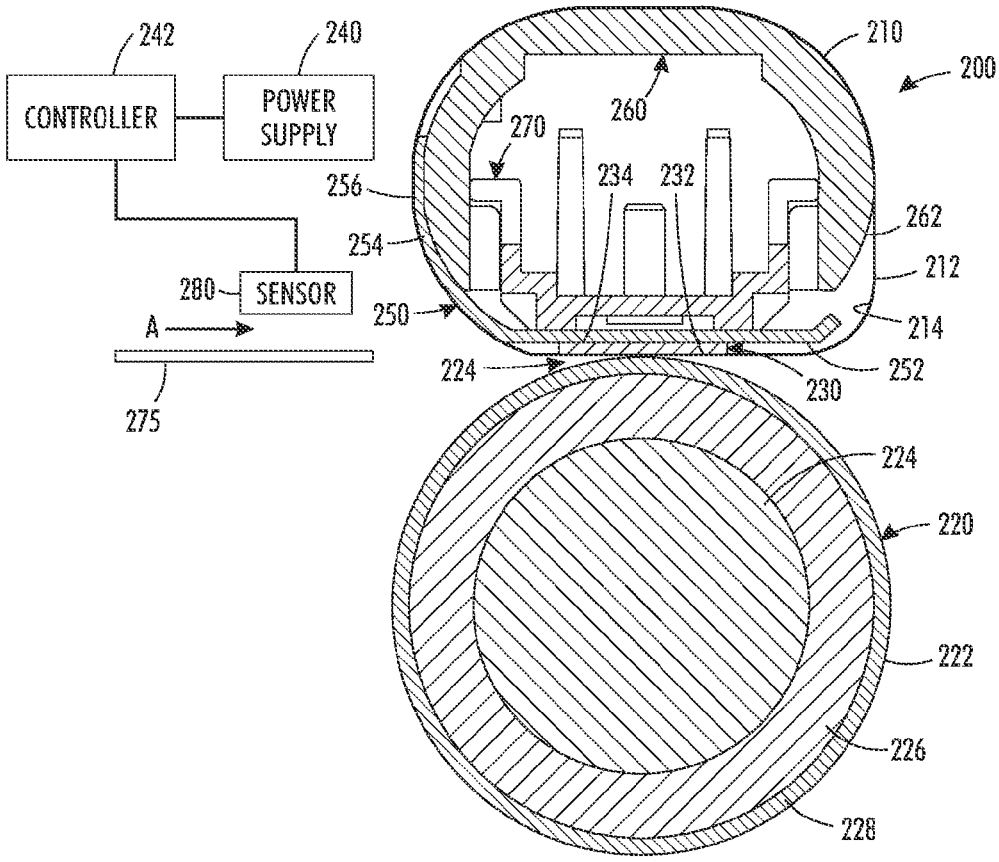
FIG. 2 is a cross-sectional view of an exemplary embodiment of fixing device.
Figure 3:
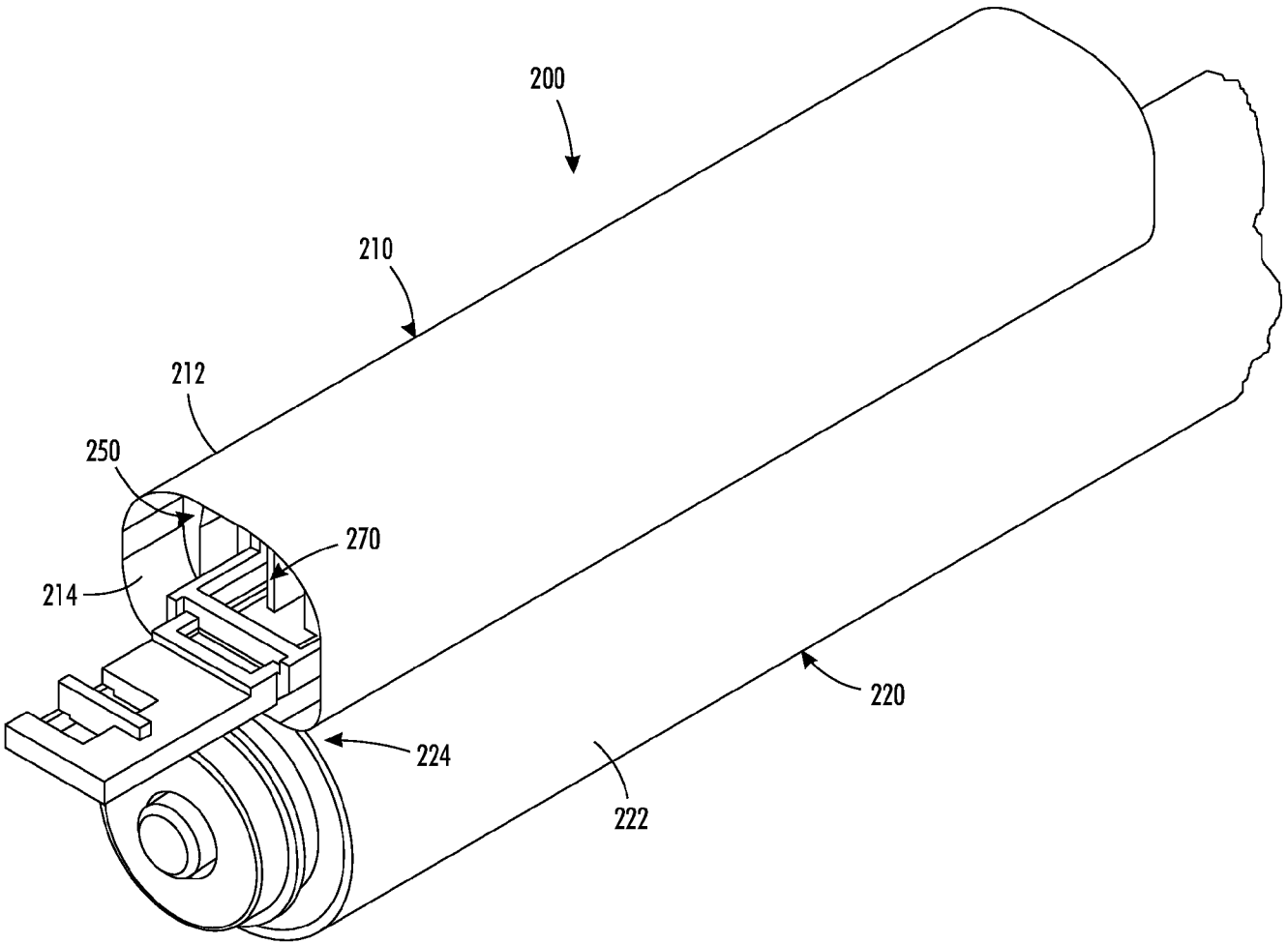
FIG. 3 is an isometric view of the fixing device of FIG. 2.

FIGS. 2 and 3 illustrate an exemplary embodiment of the fixing devices. The illustrated fixing device is a fuser 200. Embodiments of the fuser 200 shown in FIGS. 2 and 3 can be used, e.g., in place of the fuser 110 in the printing apparatus 100. The printing apparatus 100 can be used to produce prints from various media, such as coated or uncoated (plain) paper sheets, having various sizes and weights.

The fuser 200 includes a continuous fuser belt 210 with an outer surface 212 and inner surface 214, and a pressure roll 220 with an outer surface 222 contacting the outer surface 212. The outer surface 212 and the outer surface 222 of the fuser belt 210 form a nip 224. In embodiments, the pressure roll 220 is a drive roll and the fuser belt 210 is free-spinning and driven by engagement with the pressure roll 220. The pressure roll 220 rotates clock-wise to cause the belt to rotate counter-clockwise to convey media though the nip 224.

Embodiments of the fuser belt 210 can include two or more layers comprised of polymeric materials. For example, the fuser belt 210 can include a base layer forming the inner surface 214, an intermediate layer overlying the base layer, and an outer layer forming the outer surface 212, overlying the intermediate layer. The inner layer can be composed of polyimide, or the like; the intermediate layer of silicone, or the like; and the outer layer of a fluoropolymer having low-friction properties, such as polytetrafluoroethylene (Teflon®), or the like. The fuser belt 210 has a thickness and material composition that allows it be elastically deformed in the fuser 200.

In other embodiments, the fuser belt 210 can be comprised of a metal or metal alloy, such as steel, stainless steel, or the like. The metal or metal alloy can be coated with an elastomeric material forming an intermediate layer. The elastomeric material can be silicone, or the like. A material with low-friction properties, such as polytetrafluoroethylene (PFTE), perfluoroalkoxy (PFA), or the like, can be applied over the intermediate layer to form an outer layer of the fuser belt 210.

The illustrated pressure roll 220 includes a core 224, an inner layer 226 provided on the core 224, and an outer layer 228 provided on the inner layer 226. The core 224 can be comprised of a metal, metal alloy, or the like; the inner layer 226 of an elastic material, such as silicone or the like; and the outer layer 228 of a low-friction material, such as Teflon®, or the like.

The fuser 200 further includes a heater 230 located inside of the fuser belt 210. The heater 230 is stationary and extends axially (longitudinally) along the fuser belt 210. In embodiments, the heater 230 is located at the nip 224 and configured to heat the fuser belt 210 rotated to the nip 224. The heater 230 includes a heating surface 232 and an opposite surface 234. The heating surface 232 is configured to contact the inner surface 214 of the fuser belt 210. The heater 230 heats the fuser belt 210 by thermal conduction. The heating surface 232 can be planar, as shown. In embodiments, substantially the entire heating surface 232 can contact the inner surface 214 of fuser belt 210.

The body of the heater 230 can be comprised of ceramic materials. The ceramic materials have sufficiently-high thermal conductivity to transfer thermal energy to the fuser belt 210 rapidly when the heater 230 is activated. In embodiments, the heater 230 has a low thermal mass, allowing it to be rapidly heated when activated. The heating surface 232 can have a smooth finish to reduce friction between it and the inner surface 214 of the rotating fuser belt 210. A thermally-conductive lubricant can be applied to the heating surface 232 to reduce friction between it and the inner surface 214 during rotation of the fuser belt 210.

In embodiments, the heater 230 includes one or more heating elements (not shown). The heating elements are activated to heat the heating surface 232. The heating elements extend along the axial direction of the fuser belt 210. The heating elements can be embedded in the heater 230, for example. The heating elements can be connected to a power supply 240 and a controller 242 connected to the power supply 240 to control the supply of power to the heating elements to heat the fuser belt 210 to a desired temperature. The temperature of the fuser belt 210 is typically measured at the outer surface 214 close to the inlet end of the nip 224. In embodiments, the heating elements can heat substantially the entire heating surface 232 that is in contact with the fuser belt 210.

The fuser 200 further includes a heating fin 250. The illustrated embodiment of the heating fin 250 includes a planar portion 252 and a curved portion 254. The planar portion 252 is positioned in thermal contact with the surface 234 of the heater 230. As shown, the curved portion 254 of the heating fin 250 includes an outer heating surface 256 contacting the inner surface 214 of the fuser belt 210. The heating surface 256 has a curved shape. For example, the heating surface 256 can be generally semi-circular shaped, as depicted. The heating fin 250 extends along the axial direction of the fuser belt 210. The heater 230 and heating fin 250 are adapted to heat the portion of the outer surface 214 of the fuser belt 210 that defines the media path of media passing through the nip 224 (i.e., contacts the media). The heating fin 250 conducts thermal energy produced by the heater 230 to heat a pre-nip portion of the fuser belt 210 adjacent to an inlet end of the nip 224. In embodiments, the curved portion 256 of the heating fin 250 can be positioned in contact with the heater 230. In embodiments, the pre-nip portion of the fuser belt 210 can extend circumferentially over an angle of at least about 30°, such as at least about 45°, at least about 60°, or at least about 90°, about the fuser belt 210.

In embodiments, the curved portion 254 of the heating fin 250 is not actively heated by a heating element associated with the curved portion 254. In the illustrated embodiment, the heating fin 250 is comprised of a material having sufficiently-high thermal conductivity to conduct sufficient heat from the heater 230 along the planar portion 252 and to the curved portion 254 to heat the pre-nip portion of the fuser belt 210 to the desired temperature. In other embodiments, the heater and heating fin can be configured to conduct heat directly from the heater to the curved portion of the heating fin. The pre-nip portion of the fuser belt 210 can be heated to the desired temperature in embodiments of the fuser belt 210 having different structures and material compositions. For example, embodiments of the fuser belt 210 can have a coating of a polymeric material, such as an elastomer, that has a relatively lower thermal conductivity than other materials forming other portions of the fuser belt 210. The heating fin 250 can be comprised, e.g., of a metal or metal alloy, such as aluminum, aluminum alloys, copper, copper alloys, and the like. The heating fin 250 can be a fabricated plate of a single piece of material, for example. The heating fin 250 can also have a low thermal mass to allow it to quickly reach a desired heating temperature and have only a minor effect on the warm-up time of the fuser 200. In embodiments, the heating fin 250 can have a thickness of less than 3 mm, e.g., less than about 2 mm or less than about 1 mm.

The fuser 200 can have a warm-up time for the fuser belt 210 to reach the desired temperature for treating marking material on media of less than about 15 seconds. Heating the heating fin 250 with thermal energy produced by the heater 230 can reduce the loss of thermal energy that otherwise would not be transferred to the fuser belt 210, but would be transferred to other portions of the fuser 200 or to the environment.

In embodiments, the heating fin 250 is supported by a belt guide 260 located inside of fuser belt 210. The belt guide 260 includes an outer guide surface 262 contacting a portion of the inner surface 214 of the fuser belt 210. The belt guide 260 can be comprised of a material having low thermal conductivity (i.e., a thermal insulator) to reduce heat transfer from the heating fin 250 and fuser belt 210 to the belt guide 260.

The belt guide 260 is attached to a heater housing 270. The heater housing 270 extends along the axial direction (longitudinal direction) of the fuser roll 210. As shown, a portion of the heater housing 270 can overlie the planar portion 252 of the heating fin 250. The heater housing 270 can be comprised of a material having low thermal conductivity (i.e., a thermal insulator) to reduce heat transfer from the heating fin 250 to the heater housing 270.

In embodiments, the fuser 200 can include a load member (not shown) constructed to apply a load to the heater housing 270 to urge the heating surface 232 into contact with the inner surface 214 of fuser belt 210 at the nip 224. The load member extends axially along the fuser belt 210. The load member can comprise, e.g., a metal or metal alloy.

During operation, media are fed to the nip 224. FIG. 2 shows a medium 275 traveling in the process direction A toward the nip 224. The medium 275 can be, e.g., a paper sheet with at least one toner image. At the nip 224, the outer surface 212 of fuser belt 210 and the outer surface 222 of pressure roll 220 contact opposite surfaces of the medium 275. The fuser belt 210 supplies sufficient thermal energy to the medium 275 to heat the marking material to a sufficiently-high temperature to fix the marking material. The heating fin 250 pre-heats the pre-nip portion of the fuser belt 210 as the portion rotates past the heating surface 256 before rotating further to the nip 224. In embodiments, the pre-heated portion of the fuser belt 210 can enter the nip 224 at or above the temperature set point for fixing marking material, such as toner, onto media fed to the nip 224. At the nip 224, the heater 230 supplies additional thermal energy to the fuser belt 210.

In the fuser 200, a typical dwell time is about 20 ms. In embodiments, the arc length of the portion of the fuser belt 210 heated by the heating fin 250 and heater 230 can be equal to at least the media dimension in the process direction A. When the heating fin 250 pre-heats the fuser belt 210 to at least the temperature set point, the amount of work that the heater 230 then needs to supply to fix the marking material onto media at the nip 224 is reduced as compared to heating the fuser belt 210 only at nip 224 with the heater 230. When the pre-heated portion of fuser belt 210 arrives at the nip 224 at about the temperature set point or higher, the heater 230 needs to only supply an additional amount of thermal energy sufficient to increase the temperature of the marking material and media to the desired temperature, e.g., the fusing temperature of toner. The fusing temperature can be, e.g., about 180° C. to about 210° C. for different media weights. In the fuser 200, media can be contacted with the fuser belt 210 at or above the temperature set point for about the entire dwell time to produce a high fix level on media.

Figure 4:
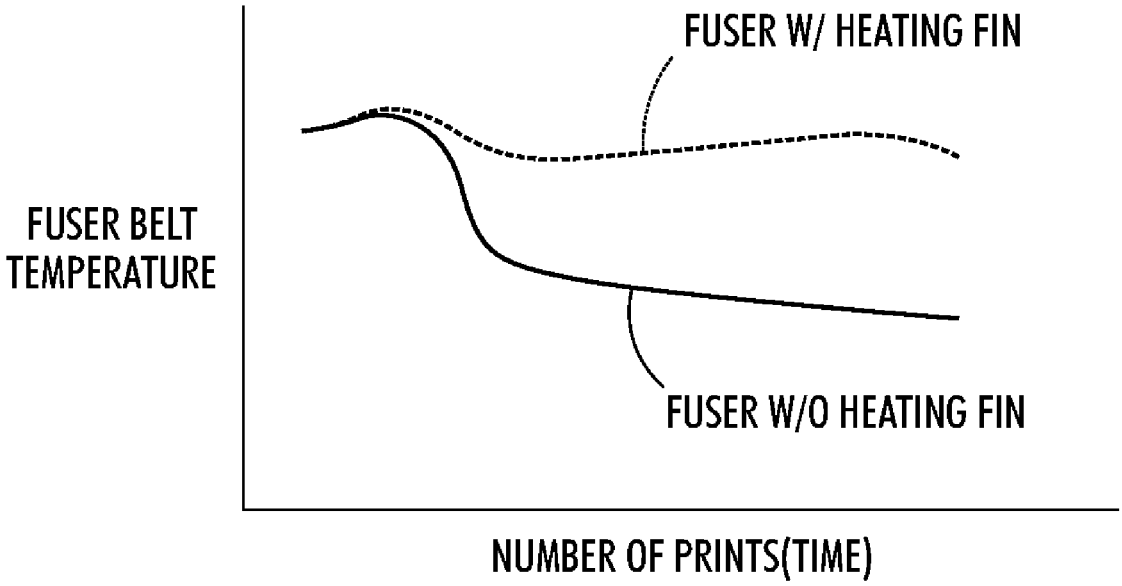
FIG. 4 depicts curves showing the fuser belt temperature as a function of the number of prints made (time) for a fuser with a heating fin and a fuser without a heating fin.

In embodiments, the fuser 200 including a heating fin 250 can provide improved temperature uniformity in both circumferential and axial directions in the fuser belt 210 during print jobs. FIG. 4 depicts modeled curves showing the fuser belt temperature at the outer surface of the fuser belt close to the inlet of the nip as a function of the number of prints (time) made for a fuser with a heating fin and a fuser without a heating fin. As shown, the fuser including a heating fin produces a generally uniform fuser belt temperature during a print run, while the fuser belt in the fuser without a heating fin shows a significant reduction in temperature during the print run. The outer surface temperature of the fuser belt with the heating fin displays the form shown in FIG. 4 in both circumferential and axial directions (i.e., across the media path) in the fuser belt.

As shown in FIG. 2, a sensor 280 (e.g., optical sensor) can be located upstream of the nip 224 to sense the arrival of the medium 275 at the nip 224. The sensor 280 can be connected to the controller 250, as shown. By sensing the arrival time of medium 275 at the nip 224, power can be supplied from the power supply 240 to the heater 230 to heat the outer surface 212 of the fuser belt 210 to the desired temperature before the medium 275 arrives at the nip 224. In embodiments, once medium 275 has passed through the nip 224, the supply of power to the heater 230 by the power supply 240 can be turned OFF until the sensor 280 senses the arrival of the next medium at nip 224.

Although the above description is directed toward fusers used in xerographic printing, it will be understood that the teachings and claims herein can be applied to any treatment of marking material on a medium in apparatuses useful for printing. For example, the marking material can be toner, liquid or gel ink, and/or heat- or radiation-curable ink; and/or the medium can utilize certain process conditions, such as temperature, for successful printing. The process conditions, such as heat, pressure and other conditions that are desired for the treatment of ink on media in a given embodiment may be different from the conditions suitable for xerographic fusing.

It will be appreciated that various ones of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, which are also intended to be encompassed by the following claims.

What is claimed is:

1. An apparatus useful for printing, comprising:

a roll including a first outer surface;

a continuous belt including an inner surface and a second outer surface forming a nip by contact with the first outer surface, the belt being driven to rotate by rotation of the roll;

a heater disposed inside of the belt and comprising a first heating surface contacting the inner surface of the belt at the nip; and a heating fin in thermal contact with the heater, the heating fin including a second heating surface extending circumferentially in contact with a pre-nip portion of the inner surface of the belt;

wherein thermal energy is conducted from the heater to the heating fin and the second heating surface pre-heats the pre-nip portion of the belt before the pre-nip portion is rotated to the nip, and the first heating surface of the heater heats the pre-heated, pre-nip portion at the nip.

2. The apparatus of claim 1, wherein:

the first heating surface is planar-shaped;

the heating fin includes a planar portion supported on the heater; and the second heating surface is convex shaped and contacts the pre-nip portion of the inner surface of the belt extending over an angle of at least about 30° to at least about 90° from adjacent to an inlet end of the nip.

3. The apparatus of claim 1, wherein the heating fin is comprised of a metal or a metal alloy.

4. The apparatus of claim 3, wherein the heating fin has a thickness of less than about 3 mm.

5. The apparatus of claim 1, further comprising:

a belt guide including an outer surface configured to support the heating fin and the inner surface of the belt; and a heater housing attached to the guide belt and supported on the heating fin.

6. The apparatus of claim 1, wherein the belt comprises an inner layer comprised of a metal, metal alloy or a polymeric material and which includes the inner surface, an intermediate layer comprised of an elastomeric material overlying the inner layer, and an outer layer comprised of a low-friction polymeric material overlying the intermediate layer and which includes the outer surface.

7. The apparatus of claim 1, wherein:

the belt has an axial length; and the first heating surface and second heating surface are configured to heat a portion of the belt, which defines a media path through the nip, to a substantially uniform temperature along the axial length.

8. The apparatus of claim 1, further comprising:

a power supply connected to the heater;

a controller connected to the power supply; and a sensor connected to the controller for sensing a medium fed to the nip;

wherein the controller controls the power supply to supply power to the heater to heat the first heating surface and second heating surface when the sensor senses the medium approaching the nip.

9. A fuser, comprising:

a pressure roll including a first outer surface;

a continuous fuser belt including an inner surface and a second outer surface forming a nip by contact with the first outer surface, the fuser belt being driven to rotate by rotation of the pressure roll;

a heater disposed inside of the belt and comprising a planar first heating surface contacting the inner surface of the fuser belt at the nip; and a heating fin in thermal contact with the heater, the heating fin including a curved second heating surface extending circumferentially in contact with a pre-nip portion of the inner surface of the fuser belt;

wherein thermal energy is conducted from the heater to the heating fin and the second heating surface pre-heats the pre-nip portion of the fuser belt before the pre-nip portion is rotated to the nip, and the first heating surface of the heater heats the pre-heated, pre-nip portion at the nip.

10. The fuser of claim 9, wherein:

the heating fin includes a planar portion supported on the heater; and the second heating surface is convex shaped and contacts the pre-nip portion of the inner surface of the fuser belt extending over an angle of at least about 30° to at least about 90° from adjacent to an inlet end of the nip.

11. The fuser of claim 9, wherein the heating fin is comprised of a metal or a metal alloy.

12. The fuser of claim 11, wherein the heating fin has a thickness of less than about 3 mm.

13. The fuser of claim 9, further comprising:

a belt guide including an outer surface configured to support the heating fin and the inner surface of the fuser belt; and a heater housing attached to the belt guide and supported on the heating fin.

14. The fuser of claim 9, wherein the fuser belt comprises an inner layer comprised of a metal, metal alloy or a polymeric material and which includes the inner surface, an intermediate layer comprised of an elastomeric material overlying the inner layer, and an outer layer comprised of a low-friction polymeric material overlying the intermediate layer and which includes the outer surface.

15. The fuser of claim 9, wherein:

the fuser belt has an axial length; and the first heating surface and second heating surface are configured to heat a portion of the fuser belt, which defines a media path through the nip, to a substantially uniform temperature along the axial length.

16. A printing apparatus, comprising:

a fuser according to claim 9;

a power supply connected to the heater;

a controller connected to the power supply; and a sensor connected to the controller for sensing a medium fed to the nip;

wherein the controller is adapted to control the power supply to supply power to the heating element to heat the first heating surface and the second heating surface when the sensor senses the medium.

17. A method of treating a marking material on a medium, comprising:

feeding a medium with a marking material to a nip formed by a first outer surface of a roll contacting a second outer surface of a belt;

rotating the belt relative to a heater disposed inside of the belt and comprising a first heating surface contacting the inner surface of the belt at the nip and relative to a heating fin in thermal contact with the heater, the heating fin including a second heating surface extending circumferentially in contact with a pre-nip portion of the inner surface of the belt;

activating the heater to conduct thermal energy from the heater to the heating fin to pre-heat the pre-nip portion of the belt with the second heating surface before the pre-nip portion is rotated to the nip and to heat the pre-heated, pre-nip portion with the first heating surface at the nip; and contacting the medium with the first outer surface of the roll and the second outer surface of the belt at the nip to treat the marking material.

18. The method of claim 17, wherein:

the first heating surface is planar-shaped;

the heating fin includes a planar portion supported on the heater; and the second heating surface is convex shaped and contacts the pre-nip portion of the inner surface of the belt extending over an angle of at least about 30° to at least about 90° from adjacent to an inlet end of the nip.

19. The method of claim 17, wherein:

the belt has an axial length; and the first heating surface and second heating surface are configured to heat a portion of the belt, which defines a media path through the nip, to a substantially uniform temperature along the axial length.

20. The method of claim 17, further comprising:

sensing a medium approaching the nip with a sensor connected to a controller; and controlling a power supply connected to the heater with the controller to supply power to the heater to heat the first heating surface and the second heating surface before the medium arrives at the nip.

* * * * *